US007926545B2

(12) United States Patent
Koda et al.

(10) Patent No.: US 7,926,545 B2
(45) Date of Patent: Apr. 19, 2011

(54) INJECTION CYLINDER IN INJECTION APPARATUS FOR MOLDING METAL MATERIAL

(75) Inventors: Toshiyasu Koda, Nagano-ken (JP); Mamoru Miyagawa, Nagano-ken (JP); Yasuhiko Takeuchi, Nagano-ken (JP)

(73) Assignee: Nissei Plastic Industrial Co., Ltd., Hanishina-gun, Nagano-ken (JP)

( * ) Notice: Subject to any disclaimer, the term of this patent is extended or adjusted under 35 U.S.C. 154(b) by 352 days.

(21) Appl. No.: 12/336,759

(22) Filed: Dec. 17, 2008

(65) Prior Publication Data

US 2009/0165984 A1 Jul. 2, 2009

(30) Foreign Application Priority Data

Dec. 28, 2007 (JP) ..... 2007-339058

(51) Int. Cl.
*B22D 17/00* (2006.01)

(52) U.S. Cl. ..... 164/312

(58) Field of Classification Search ..... 164/303, 164/312, 113
See application file for complete search history.

(56) References Cited

U.S. PATENT DOCUMENTS 3,672,440 A * 6/1972 Miura et al. ..... 164/312
3,685,572 A * 8/1972 Carver et al. ..... 164/312
5,983,978 A * 11/1999 Vining et al. ..... 164/312

FOREIGN PATENT DOCUMENTS

JP 2004-050248 2/2004
WO WO 90/09251 8/1990

* cited by examiner

*Primary Examiner* — Kevin P Kerns
(74) *Attorney, Agent, or Firm* — Weingarten, Schurgin, Gagnebin & Lebovici LLP

(57) ABSTRACT

Leakage of molten metal material from between a cylinder body having a tight-fitting liner and a nozzle member of an injection apparatus is prevented through the interaction of the nozzle member and a coupling ring with the liner.

5 Claims, 2 Drawing Sheets

INJECTION CYLINDER IN INJECTION APPARATUS FOR MOLDING METAL MATERIAL

BACKGROUND OF THE INVENTION

1. Field of the Invention

The invention relates to an injection cylinder in an injection apparatus for molding a metal material, wherein a molten metal material is injected into a mold from a front nozzle by using a plunger.

2. Description of the Related Art

Injection apparatuses that have been used for molding a metal material are classified into screw type and plunger type. Both types have an injection cylinder of almost the same basic configuration, with only differences in the means for melting and injecting the metal material.

Screw type injection apparatuses have a cylinder body that has a nozzle member attached to its front end and a feed opening formed in its rear top. Powdered metal material charged through the feed opening is heated to melt before it reaches the front part of the cylinder body by screw rotation. The molten material is measured (accumulated) in the front part of the cylinder body by retreating the screw, and then injected into a mold from the front nozzle by advancing the screw. (See International Patent Publication No. WO 90/09251)

Some plunger type injection apparatuses have a cylinder body that melts and stores a large amount of metal material inside. A portion of the molten material is measured (accumulated) in the front part of the cylinder body by retreating the plunger before injected out of the nozzle by advancing the plunger. In others, the metal material is melted in a melting furnace or other unit before fed into the cylinder body. In this melt feed method, the feed opening is formed in the top of the front part of the cylinder body.

Since metal materials require high temperatures above their liquidus curve to melt (for example, 595° C. or above for magnesium alloys), the relevant components of the injection cylinder are made of high-tension steel products having excellent high-temperature strength. For the sake of improved wear resistance on the cylinder's inner surface where the screw moves back and forth, some cylinder bodies have a cylinder liner inserted inside which is made of an alloy having higher wear resistance than that of steel products. (See Japanese Patent Application Laid-Open No. 2004-50248)

Possible means for attaching a cylinder liner to inside of a cylinder body include a shrink fit, as well as a tight fit where the cylinder liner is inserted at room temperatures before brought into close contact with the inner surface of the cylinder by thermal expansion. In either case, the cylinder liner is polished in the inner surface for increased bore diameter when the inner surface of the cylinder liner wears out after repetitive molding. A screw or plunger corresponding to that inside diameter is then selected to continue operation. With a shrink fit, the cylinder liner is difficult to pull out. Both the cylinder body and the cylinder liner are thus replaced with new ones when worn out beyond use limit.

For a tight fit, the cylinder liner is made of a material having a coefficient of thermal expansion higher than that of the material of the cylinder body. The cylinder liner is inserted into the cylinder body at room temperatures, and is expanded together with the cylinder body by the heating upon starting molding so that the cylinder liner comes into close contact with the cylinder's inner surface due to a difference between their coefficients of thermal expansion. In other words, when the two members cool down to room temperatures and the thermal expansion disappears, they restore their original sizes which facilitate pulling the cylinder liner out. This provides the economical advantage that the cylinder liner can be removed when the wearing in the inner surface reaches the use limit, and a new cylinder liner can be inserted into the cylinder body for use.

The close contact between the cylinder liner and the cylinder's inner surface is based on the difference between the coefficients of thermal expansion of their respective materials. A gap can thus result from insufficient contact if the inside diameter of the cylinder and the outside diameter of the cylinder liner have too large a tolerance. Meanwhile, too small a tolerance makes the insertion of the cylinder liner into the cylinder body before the thermal expansion operation so tight that the two members suffer unnecessary stress from thermal expansion. The application of injection pressure upon each molding also contributes to a drop in durability, shortening the life of the injection cylinder easily.

In the screw type apparatuses where the feed opening is formed in the rear part of the cylinder body, the metal material is yet to be melted and is in a solid state when in the vicinity of the feed opening. This means no penetration of the molten metal material from around the feed opening into between the cylinder liner and the cylinder's inner surface. In the plunger type apparatuses, on the other hand, the feed opening is arranged in the top of the front part where to melt and feed the metal material. The molten metal material can thus penetrate from around the feed opening into between the cylinder liner and the inner surface of the cylinder body because of injection pressure, and can even leak out from the contacting surfaces between the cylinder body and the nozzle member. For this reason, the cylinder body and the nozzle member are coupled to each other with a seal ring between their contacting surfaces. Making a plastic deformation for sealing, this seal ring is prone to degradation and requires replacement each time doing maintenance on the cylinder, the cylinder liner, the nozzle, the plunger, etc.

SUMMARY OF THE INVENTION

This invention has been achieved in order to solve the foregoing problems that occur when a cylinder liner is attached to inside of a cylinder body by means of a tight fit. It is thus an object of the invention to provide a new injection cylinder in an injection apparatus for molding a metal material, which can prevent leakage of the molten metal material even if its cylinder liner is tight-fitted such that both the front end of the cylinder liner and the rear end of a nozzle member are fitted to an opening in the front end of a cylinder body, and the cylinder liner is fixed to the cylinder body by means of the nozzle member. Another object is to provide a new injection cylinder in an injection apparatus for molding a metal material, which requires no seal ring.

This invention relates to an injection cylinder in an injection apparatus for molding a metal material, comprising the following members:

a cylinder body of cylindrical form, having a first fitting part and a larger-diametered second fitting part in an opening in its front end, a feed opening being formed in a top area of the cylinder body;

a cylinder liner of cylindrical form, a flange being formed on a periphery of the front end of the cylinder liner, a feed hole being formed in a predetermined location of a top area of the cylinder liner, the cylinder liner being brought into close contact with an inner surface of the cylinder body by means of thermal expansion with the cylinder liner inserted into the cylinder body from the opening side so that the flange is fitted to the first fitting part and so that the feeding hole and the feeding opening are in the same position;

a nozzle member of cylindrical form, having a nozzle at its extremity and a flange on a periphery of its rear end, the flange being fitted to the second fitting part so that a rear end face of the flange is in contact with a front end face of the flange of the cylinder liner; and a coupling ring arranged around a cylindrical part of the nozzle member, a rear end face of the coupling ring being engaged with a front end face of the nozzle member and fastened to a front end face of the opening of the cylinder body with a bolt, whereby the nozzle member and the cylinder body are tightened to each other with the flange of the cylinder liner interposed therebetween.

The injection cylinder according to the present invention also covers the following aspect: the cylinder body is made of a high-tension steel product having excellent high-temperature strength at and above a liquidus temperature of the metal material; the cylinder liner is made of a cobalt alloy having a coefficient of thermal expansion higher than that of the steel product; and a tolerance between the inside diameter of the cylinder body and the outside diameter of the cylinder liner is set such that the fitting therebetween is either a loose fit or a transition fit before thermal expansion, and a tight fit after thermal expansion.

The injection cylinder according to the present invention also covers the following aspect: the cylinder liner is positioned by a lock member so that the feed opening and the feed hole lie in the same position, the lock member being arranged across a border between an edge of the flange of the cylinder liner and an opening rim of the first fitting part of the cylinder body, whereby the feed hole of the cylinder liner and the feed opening are maintained in the same position.

The injection cylinder according to the present invention also covers the following aspect: the nozzle member has an annular projection concentric to and formed around an opening in the rear end face of the flange of the nozzle member; and the annular projection is in contact with around an opening in the front end face of the cylinder liner.

The injection cylinder according to the present invention also covers the following aspect: the flange around the rear end of the nozzle member has such a thickness that the front end face of the flange protrudes from the front end face of the opening of the cylinder body when the flange is fitted into the opening of the cylinder body; and the protrusion of the front end face of the flange creates a tightening gap between the front end face of the opening and the rear end face of the coupling ring.

According to the present invention, the flange of the cylinder liner and the flange of the nozzle member are fitted to the opening in the front end of the cylinder body so that the front end of the cylinder liner and the rear end of the nozzle member are in contact with each other. The nozzle member is also pressed against the cylinder body by means of the coupling ring and the bolt. The flange of the cylinder liner can thus be pressed into contact with a seating surface of the first fitting part, whereby the nozzle member is coupled to and the cylinder liner is fixed to the cylinder body. Besides, the fastening force of the bolt to the coupling ring concentrates upon the flange of the cylinder liner through the nozzle member. Consequently, the fixing and the coupling inside the opening of the cylinder body can be achieved tightly without a gap even in the absence of seal members, making it possible to prevent the leakage of the molten material from between the cylinder body and the nozzle member even with the tight fit.

The nozzle member can be coupled to and the cylinder liner can be fixed to the cylinder body simply by fastening the coupling ring to the cylinder body with the bolt. This eliminates the need for bolts that fix the cylinder liner to the seating surface of the fitting part in the opening of the cylinder body, and for bolt holes in the flange of the cylinder liner. This also facilitates replacing the cylinder liner. The flange of the cylinder liner does not have any bolt holes which tend to create a leaking gap. A molten metal material getting into between the cylinder liner and the inner surface of the cylinder from the border between the feed opening and the feed hole, if any, therefore cannot leak out from such bolt holes.

The front end face of the flange of the nozzle member (the surface where the coupling ring comes into contact with) is protruded from the front end face of the cylinder body, and the annular projection formed on the rear end face of the flange is put into contact with the front end face of the cylinder liner. Because of this coupling mode, the coupling ring is kept out of contact with the front end face of the cylinder body. The fastening force therefore concentrates on the cylinder liner, increasing the surface pressure between the contacting surfaces of the annular projection and the front end face of the cylinder liner, and by extension the surface pressure between the flange of the nozzle member and the seating surface of the second fitting part. Leakage of the molten material is thus prevented over a long period of time without the intervention of a seal member.

The tolerance is set such that the fitting between the inside diameter of the cylinder and the outside diameter of the cylinder liner is either a loose fit or a transition fit before thermal expansion, and is a tight fit after thermal expansion. The close contact can thus be achieved without increasing mutual interference due to thermal expansion force, so that the cylinder's inner surface and the cylinder liner will not create a gap for the molten material to get into. This, combined with the fixing and coupling of the cylinder liner and the nozzle member to the front end of the cylinder, makes it possible to prevent the leakage of the molten material from between the cylinder body and the nozzle member with even higher reliability.

DETAILED DESCRIPTION OF THE PREFERRED EMBODIMENT

Figure 1:
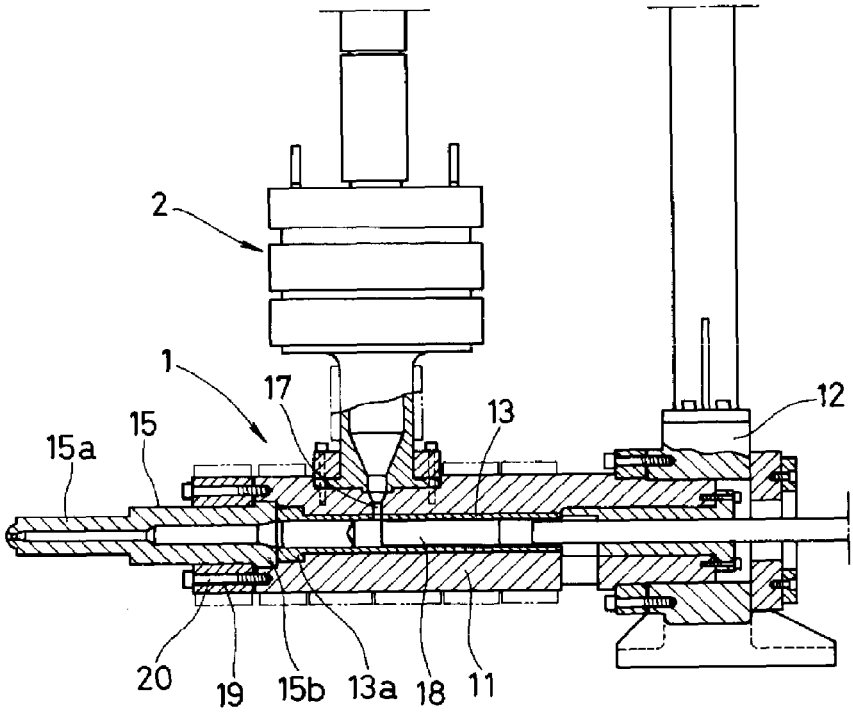
FIG. 1 is a longitudinal sectional view of an injection cylinder in an injection apparatus for molding a metal material according to this invention.
Figure 2:
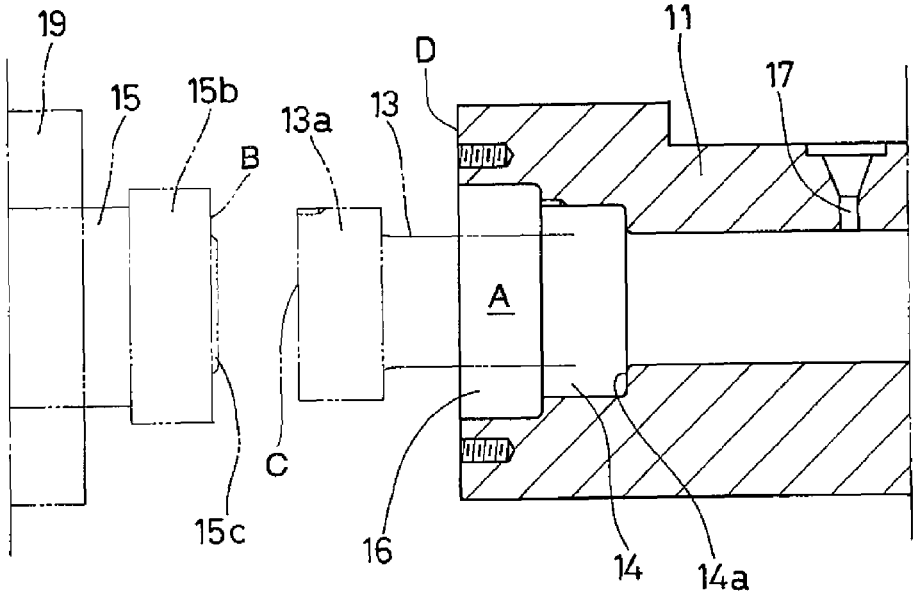
FIG. 2 is a longitudinal sectional view of the front end of a cylinder body, with a cylinder liner and a nozzle member in dashed lines.
Figure 3:
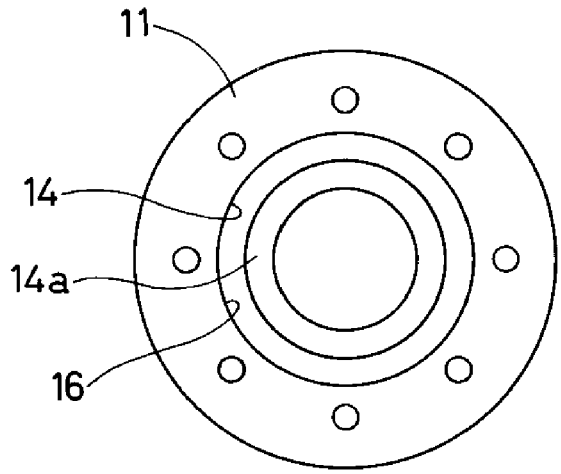
FIG. 3 is a front view of the front end of the cylinder body.
Figure 4:
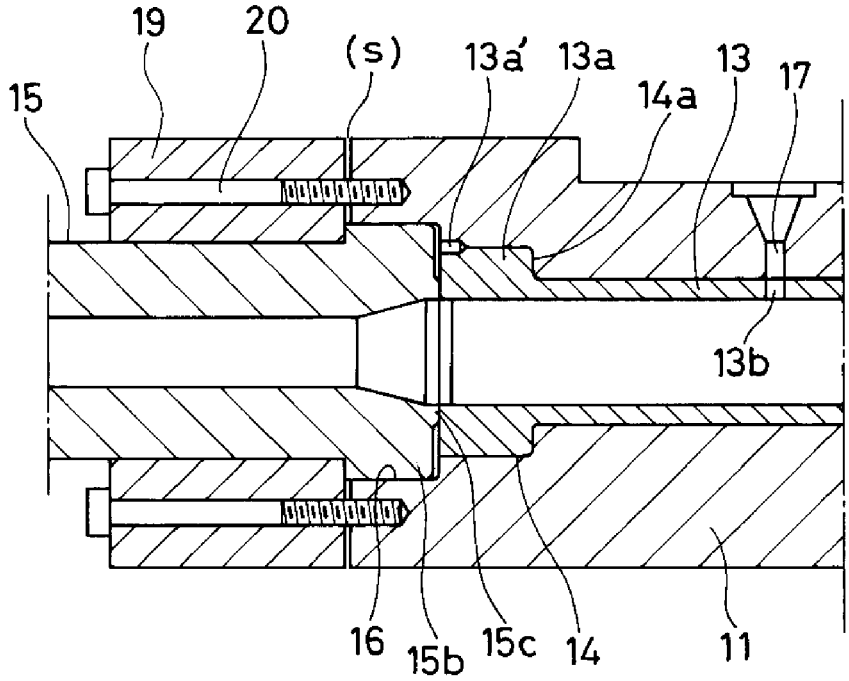
FIG. 4 is a longitudinal sectional view of the front end of the cylinder body to which the cylinder liner and the nozzle member are attached.

In FIGS. 1 to 4, the reference numeral 1 denotes an injection cylinder, which is horizontally placed on a not-shown base with the rear end of its cylinder body 11 passed through and fixed to a holding plate 12. The cylinder body 11 has heating means on its periphery. The reference numeral 2 denotes a material melting and storing unit which is arranged on the front part of the cylinder body 11.

The cylinder body 11 is made of a cylinder having a first fitting part 14 and a second fitting part 16 in an opening A in its front end. A flange 13*a* of a cylinder liner 13 is to be fitted to the first fitting part 14, and a flange 15*a* of a nozzle member 15 is to be fitted to the second fitting part 16. A feed opening 17 is formed in the top of the front part of the cylinder body 11. As will be described, the cylinder liner 13 is passed through this cylinder body. The inner wall of this cylinder liner 13 forms a cylinder hole, into which a plunger 18 is inserted so as to be capable of reciprocation from the rear end of the cylinder hole to inside of the rear end of the nozzle member 15.

The cylinder liner 13 is made of a cylindrical member having the flange 13*a* formed on the periphery of its front end. A feed hole 13*b* is formed in a predetermined location of the cylindrical member. When the cylinder liner 13 is passed through and fixed to the cylinder body 11, the feed hole 13*b* and the feed opening 17 formed in the cylinder body 11 come to the same position.

This cylinder liner 13 is inserted from the opening A in the front end of the cylinder body 11 at room temperatures with the feed hole 13*b* directly upward until the flange 13*a* comes inside the first fitting part 14. For positioning, a lock pin 13*a*' is driven into a pin hole which is formed across the border between the flange edge and the opening rim of the first fitting part, whereby the feed hole 13*b* and the feed opening 17 are maintained in the same position. The inserted cylinder liner 13 makes a tight fit due to thermal expansion, coming into close contact with the inner surface of the cylinder body 11.

The nozzle member 15 has a body of cylindrical form, with a nozzle 15*a* at its extremity and a flange 15*b* on the periphery of its rear end. An annular projection 15*a* concentric to an opening in the rear end face B of the flange 15*b* is protruded from around the opening. The flange has such a thickness that the front end face of the flange 15*b* protrudes from the front end face D of the cylinder body when the flange is fitted to the second fitting part 16 in the opening of the cylinder body 11. A coupling ring 19 for coming into engagement with the front end face of the flange 15*b* is fitted onto the periphery of the cylindrical body of the nozzle member.

To attach this nozzle member 15, the cylinder liner 13 is inserted and fitted into the cylinder body 11 before the flange 15*b* of the nozzle member 15 is fitted to the second fitting part 16 so that the annular projection 15C on the rear end face B of the flange 15*b* is in contact with the front end face C of the flange 13*a* of the cylinder liner 13. The coupling ring 19 is then engaged with the front end face of the flange 15*b* and fastened to the cylinder body with bolts 20, whereby the flange 15*b* is coupled to the front end D of the cylinder body 11. Since the nozzle member 15 and the cylinder body 11 are coupled to each other with the flange 13*a* of the cylinder liner 13 interposed therebetween, the fastening force of the bolts 20 to the coupling ring 19 concentrates upon the flange 13*a* of the cylinder liner 13 through the rear end of the nozzle member 15. The nozzle member and the cylinder liner are thus coupled without a gap tightly in the opening A of the cylinder body 11.

The foregoing coupling of the nozzle member 15 with the cylinder body 11 also fixes the cylinder liner 13 and the nozzle member 15 to the cylinder body 11 by means of the bolts 20. This eliminates the need for bolts that fix the flange 13*a* to a seating surface 14*a* of the first fitting part 14, and the need to make bolt holes in the flange 13*a*. Furthermore, the contacting surfaces between the flange 13*a* and the seating surface 14*a*, and between the annular projection 15*c* on the rear end face B of the nozzle member 15 and the front end face C of the flange 13*a* of the cylinder liner 13, have no gap for the molten material to get into. Consequently, even if the inner wall of the cylinder body 11 and the outer periphery of the cylinder liner 13 cause a gap therebetween and the molten metal material penetrates into it, the molten metal material is blocked by the close contact between the flange 13*a* and the seating surface 14*a* so as not to leak out from between the cylinder body 11 and the nozzle member 15.

In the foregoing coupling, the annular projection 15*c* on the rear end face B of the flange 15*b* of the nozzle member 15 is in contact with the front end face C of the flange 13*a* of the cylinder liner 13. The front end face of the flange 15*b* protrudes from the front end face D of the cylinder body 11. The coupling ring 19 in engagement with the flange 15*a* creates a gap (s) from the front end face D of the cylinder body 11, not in contact with the front end face of the cylinder body 11. This concentrates the fastening force of the bolts 20 upon the cylinder liner 13, increasing the surface pressure on the contacting surface of the annular projection 15*c*, and by extension the surface pressure between the flange 13*a* and the seating surface 14*a* of the fitting part. The close contact between these contacting surfaces therefore improves further, making it possible to prevent the leakage of the molten material over a long period of time without the intervention of a seal member.

The cylinder body 11 is preferably made of a high-tension steel product that has excellent high-temperature strength at and above the liquidus temperature of the metal material (for magnesium alloys, approximately 595° C.), such as SKD61. The cylinder liner 13 is preferably made of a cobalt alloy having a coefficient of thermal expansion higher than that of the steel product, such as Stellite™. Given a cylinder body of ϕ62 in inside diameter and a cylinder liner of ϕ62 in outside diameter, the fitting therebetween is preferably H7/g6 (loose fit) or H7/h6 (transition fit). This range reduces the effect of mutual interference between the cylinder body and the cylinder liner resulting from thermal expansion, while preventing the penetration of the molten metal material into the contacting surfaces therebetween. Tighter fitting than in the foregoing range is undesirable since unnecessary stress can occur on both the members because of excessive thermal expansion, with a problem in durability due to injection pressure that occurs each time molding a metal material.

What is claimed is:

1. An injection cylinder in an injection apparatus for molding a metal material, comprising:

a cylinder body, having a first fitting part and a larger-diametered second fitting part in an opening in a front end thereof, a feed opening being formed in a top area of the cylinder body;

a cylinder liner of cylindrical form, a flange being formed on a periphery of the front end of the cylinder liner, a feed hole being formed in a predetermined location of a top area of the cylinder liner, the cylinder liner being brought into close contact with an inner surface of the cylinder body by means of thermal expansion with the cylinder liner inserted into the cylinder body from the opening side so that the flange is fitted to the first fitting part and so that the feed hole and the feed opening are in the same position;

a nozzle member of cylindrical form, having a nozzle at an extremity thereof and a flange on a periphery of a rear end thereof, the flange being fitted to the second fitting part so that a rear end face of the flange is in contact with a front end face of the flange of the cylinder liner; and a coupling ring arranged around a cylindrical part of the nozzle member, a rear end face of the coupling ring being engaged with a front end face of the nozzle member and fastened to a front end face of the opening of the cylinder body with a bolt, whereby the nozzle member and the cylinder body are tightened to each other with the flange of the cylinder liner interposed therebetween.

2. The injection cylinder in an injection apparatus for molding a metal material according to claim 1, wherein: the cylinder body is made of a high-tension steel product having excellent high-temperature strength at and above a liquidus temperature of the metal material; the cylinder liner is made of a cobalt alloy having a coefficient of thermal expansion higher than that of the steel product; and a tolerance between the inside diameter of the cylinder body and the outside diameter of the cylinder liner is set such that the fitting therebetween is either a loose fit or a transition fit before thermal expansion, and a tight fit after thermal expansion.

3. The injection cylinder in an injection apparatus for molding a metal material according to claim 1, wherein the cylinder liner is positioned by a lock member so that the feed opening and the feed hole lie in the same position, the lock member being arranged across a border between an edge of the flange of the cylinder liner and an opening rim of the first fitting part of the cylinder body, whereby the feed hole of the cylinder liner and the feed opening are maintained in the same position.

4. The injection cylinder in an injection apparatus for molding a metal material according to claim 1, wherein the nozzle member has an annular projection concentric to and formed around an opening in the rear end face of the flange of the nozzle member with the annular projection being in contact with around an opening in the front end face of the cylinder liner.

5. The injection cylinder in an injection apparatus for molding a metal material according to claim 1, wherein the flange around the rear end of the nozzle member has such a thickness that the front end face of the flange protrudes from the front end face of the opening of the cylinder body when the flange is fitted into the opening of the cylinder body; and the protrusion of the front end face of the flange creates a tightening gap between the front end face of the opening and the rear end face of the coupling ring.

* * * * *